United States Patent [19]

Bailey

[11] Patent Number: 4,475,030

[45] Date of Patent: Oct. 2, 1984

[54] GLOW PLUG HAVING RESILIENTLY MOUNTED CERAMIC SURFACE-IGNITION ELEMENT

[75] Inventor: John M. Bailey, Dunlap, Ill.

[73] Assignee: Caterpillar Tractor Co., Peoria, Ill.

[21] Appl. No.: 527,778

[22] PCT Filed: Sep. 25, 1981

[86] PCT No.: PCT/US81/01312

§ 371 Date: Sep. 25, 1981

§ 102(e) Date: Sep. 25, 1981

[87] PCT Pub. No.: WO83/01093

PCT Pub. Date: Mar. 31, 1983

[51] Int. Cl.[3] ..... F23Q 7/22

[52] U.S. Cl. ..... 219/270; 123/145 A; 219/523; 219/553; 338/316; 361/266

[58] Field of Search ..... 219/267, 270, 523, 553; 361/264, 265, 266; 123/145 R, 145 A; 338/235, 316; 373/133, 134

[56] References Cited

U.S. PATENT DOCUMENTS

| | | | |
|---|---|---|---|
| 1,715,018 | 5/1929 | von Brockdorff | 338/316 X |
| 1,947,793 | 2/1934 | O'Neil et al. | 338/235 |
| 2,178,659 | 11/1939 | White | 123/145 A |
| 2,198,850 | 4/1940 | White | 123/145 A |
| 2,769,074 | 10/1956 | Dycherhoff | 338/316 X |
| 2,858,403 | 10/1958 | Butler, Jr. | 219/523 |
| 3,319,130 | 5/1967 | Betteridge | 123/145 A X |
| 3,372,305 | 3/1968 | Mikulec | 361/266 X |
| 3,399,266 | 4/1966 | Thomas | 373/133 X |
| 3,749,980 | 7/1973 | Baxter | 123/145 A X |
| 3,835,296 | 9/1974 | Middough et al. | 219/553 |
| 3,875,477 | 4/1975 | Fredriksson et al. | 219/270 X |
| 3,943,218 | 3/1976 | Dietze et al. | 219/553 X |
| 4,107,510 | 8/1978 | Tombs et al. | 219/270 |
| 4,395,623 | 7/1983 | Shimada et al. | 219/553 X |

FOREIGN PATENT DOCUMENTS

| | | | |
|---|---|---|---|
| 2398969 | 3/1979 | France | 219/270 |
| 860466 | 5/1961 | United Kingdom | 123/145 A |

*Primary Examiner*—Volodymyr Y. Mayewsky
*Attorney, Agent, or Firm*—Anthony N. Woloch

[57] ABSTRACT

An improved glow plug (10) which is adapted to be continuously electrically heated to a preselected elevated temperature in order to ignite relatively lower-cetane-number alternative fuels. The glow plug (10) includes a ceramic surface ignition element (20) disposed substantially externally of the glow plug body (18) and means (24) for permitting thermal expansion and contraction of the ignition element (20) while maintaining continuous electrically-conductable and gas-impermeable contact between the ignition element (20) and the glow plug body (18).

2 Claims, 4 Drawing Figures

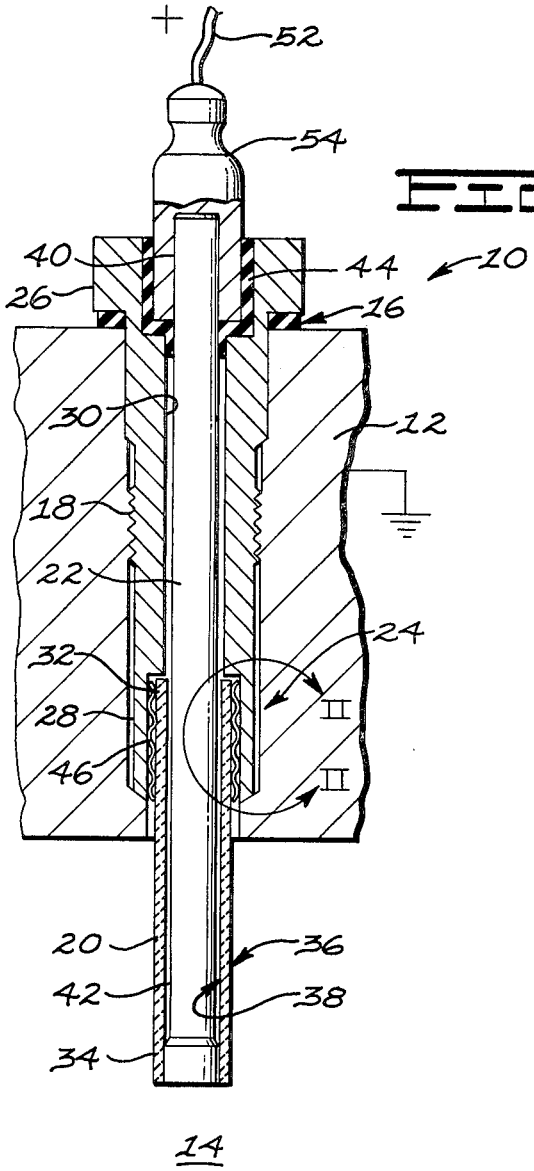
FIG 1
FIG 2
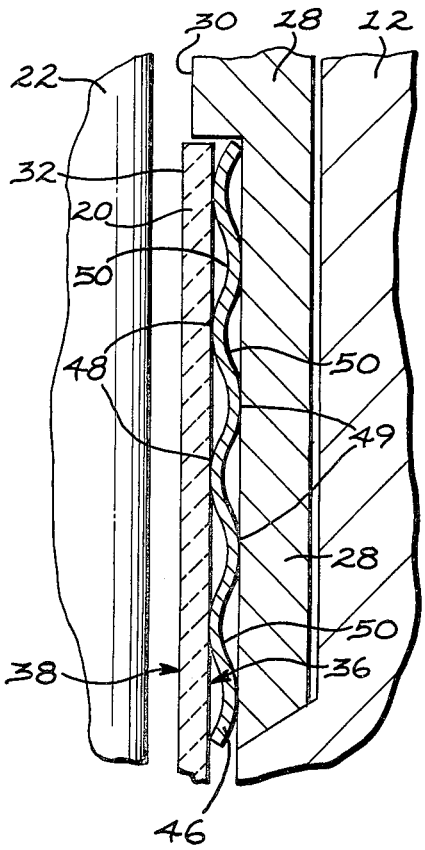

GLOW PLUG HAVING RESILIENTLY MOUNTED CERAMIC SURFACE-IGNITION ELEMENT

DESCRIPTION

1. Technical Field

This invention relates to a combustion system for a compression-ignition engine and, more particularly, to an improved glow plug which is adapted for igniting relatively lower-cetane-number fuels as well as conventional relatively higher-cetane-number fuels.

2. Background Art

In the face of ever-decreasing supplies of conventional diesel fuels, it would be very advantageous if conventional compression-ignition engines could be easily adapted to burn more plentiful alternative fuels such as, for example, alcohol, the light hydrocarbon fractions of petroleum, and synthetic fuels made from coal or shale oil. However, these relatively lower-cetane-number alternative fuels require an elevated or higher temperature for autoignition than that which is developed during the compression stroke of conventional compression-ignition engines. For example, methanol, a fairly plentiful alternative fuel which is attracting world-wide interest, will not autoignite in a conventional diesel engine because the cetane numer of methanol is only about 0 to 10 whereas conventional Grade 2-D diesel fuel has a cetane number of at least 40 and thus easily autoignites.

It is known, however, that relatively lower-cetane-number fuels can be ignited with a hot surface such as a glow plug by the phenomenon known as surface ignition. The required temperature of the hot surface, in order to facilitate ignition of a fuel, is not directly related to the cetane number of a given fuel but depends on other parameters including fuel composition, engine speed, and other engine operating conditions such as inlet air temperature.

I have found that a glow plug continuously maintained at a temperature of at least 871° C. (1600° F.) is required to facilitate ignition of methanol in an operating compression-ignition engine. Other investigators have determined that other alternative fuels such as ethanol and isooctane petroleum fuel require substantially greater glow plug temperatures to facilitate ignition.

Standard starting-aid glow plugs are designed to be electrically heated to about 816° to 1038° C. (1500° to 1900° F.) only during startup of an engine burning conventional diesel fuels. The ignition elements of known starting-aid glow plugs, such as described in U.S. Pat. No. 3,749,980 issued to Baxter on July 31, 1973, typically comprise a metallic casing which contains a helical electrical resistance wire embedded in a powdered electrically-insulative material, such as magnesium oxide. After engine startup and during engine operation these standard glow plugs are no longer electrically heated such that their temperature becomes merely a function of engine load or power output and thus normally relatively lower compared to their electrically-energized state. Consequently, when this type of glow plug is continuously electrically heated, to the elevated temperature range required to ignite a wide range of relatively lower-cetane-number alternative fuels in a conventional compression-ignition engine, the very hot metallic casing of this glow plug, which is exposed to the gases of the combustion chamber, rapidly deteriorates due to oxidation and other chemical attack.

It is well known that electrically-conductive ceramics, such as silicon carbide, adequately resist oxidation and other chemical attack at temperatures as high as about 1371° C. (2500° F.). However, ceramic material is also very brittle and therefore prone to failure when subjected to the severe cyclic thermal conditions of an engine. Another starting-aid glow plug, as described in U.S. Pat. No. 4,237,843 issued to Page et al on Dec. 9, 1980, has a small, solid, cylindrical, ceramic heating element substantially encased in a metallic-alloy body part and exposed to the gases of the combustion chamber through holes formed in the body part. The glow plug also has a two part electrode and conductive braid which is intended to accommodate any differential thermal expansion which may occur between the electrode rod, the body, and ceramic heating element. On the other hand, since this heating element is mounted internal rather than external of the glow plug, there is less surface area to help facilitate surface ignition of relatively lower-cetane number fuels. Moreover, the combustion gases are permitted to flow through an annular passage formed between the electrode rod and the body. Thus combustion debris can deposit on and eventually clog the annular passage and inhibit relative movement between the electrode rod and body. This clogging action can thereby constrain differential thermal growth between the electrode rod and ceramic heating element and thereby cause stresses which can eventually fracture the very brittle ceramic material. Furthermore, the metallic-alloy body part which encases the ceramic heating element would be subject to accelerated and severe oxidation and other chemical attack if the glow plug were continuously electrically heated within the elevated temperature range required to ignite a wide range of relatively lower-cetane-number alternative fuels.

For many years ceramic igniters have been used in gas-burning appliances such as furnaces, kitchen ranges, and clothes dryers. One known gas appliance ceramic igniter is described in U.S. Pat. No. 3,372,305 issued to Mikulec on Mar. 5, 1968 wherein a silicon carbide tube is reinforced by an aluminum oxide rod which passes through the tube. The tube has a spiral configuration cut at one end portion to serve as the electrical resistance hot zone while the other end portion of the tube is mounted within a split-clip type of contact. Another gas appliance ceramic igniter of this type is described in U.S. Pat. No. 3,875,477 issued to Fredriksson et al on Apr. 1, 1975 wherein the ceramic igniter is of a monolithic flat elongated configuration, essentially rectangular in cross-section, having two wing-shaped terminal end portions and at least one hot zone hairpin-shaped leg.

Although such known gas appliance ceramic igniters have satisfactorily served the applications for which they were designed, the above patents do not teach or suggest how a ceramic element can be externally mounted to a glow plug body for a compression-ignition engine and yet overcome at least two major obstacles associated with this application. First, the ceramic element must be mounted so that it is permitted to thermally expand and contract relative to other parts of the glow plug in order to avoid stress-induced fractures and yet maintain a fairly constant electrical contact resistance with the rest of the electrical circuit in the glow plug. Moreover, the means for attaching the ceramic element to the glow plug body should not take the form of stress concentrators, such as slots, spiral cuts, sharp edges, or threads, since these can also promote early local failure. Second, the ceramic element must be mounted so that it can thermally grow or contract and yet maintain an adequate seal with the rest of the glow plug to prevent leakage of the approximately 6895 to 13,790 KPa (1000 to 2000 psi) gas pressure periodically developed in the combustion chamber for power.

In summary, the above patents do not teach or suggest an improved glow plug which is adapted to be continuously electrically heated in order to ignite relatively lower-cetane-number alternative fuels in a conventional compression-ignition engine. Furthermore, the above patents do not teach or suggest a way of externally mounting an electrically-conductive ceramic surface ignition element to the glow plug body such that the ignition element is permitted to thermally expand and contract and yet maintain continuous electrically-conductable and gas-impermeable contact with the glow plug body.

The present invention is directed to overcoming one or more of the problems as set forth above.

DISCLOSURE OF THE INVENTION

In one aspect of the present invention an improved glow plug is disclosed, adapted to be continuously electrically heated within a preselected elevated temperature range, having a hollow, cylindrical, electrically-conductable, ceramic surface ignition element being disposed substantially externally of the glow plug body and means for permitting thermal expansion and contraction of the ignition element while maintaining continuous electrically-conductable and gas-impermeable contact between the ignition element and the glow plug body.

This improved glow plug is, for example, substituted for the standard glow plug in a conventional compression-ignition engine to ensure ignition of relatively lower-cetane-number alternative fuels which require a higher ignition temperature than previous compression-ignition combustion chambers can provide. This improved glow plug may also be used in any other application such as industrial furnaces where a surface ignition element, maintained at a sufficient elevated temperature, is required to initiate combustion of fuels.

BRIEF DESCRIPTION OF THE DRAWINGS

FIG. 1 is a cross-sectional view of the preferred embodiment of the present invention;

FIG. 2 is an enlarged partial view of FIG. 1 taken along circular boundary II—II;

BEST MODE FOR CARRYING OUT THE INVENTION

Figure 3:
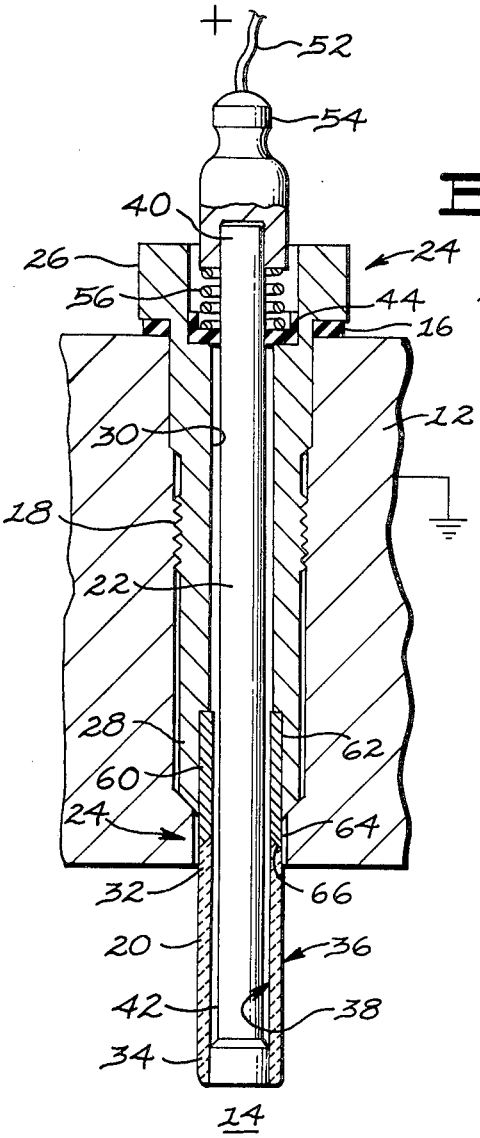
FIG. 3 is a cross-sectional view of a first alternative embodiment of the present invention.

Referring to FIGS. 1 through 4 wherein similar reference characters designate similar elements throughout the figures, there are shown three alternative embodiments of the improved glow plug of this invention.

In FIG. 1, the preferred embodiment, a glow plug generally indicated at 10, is shown threadably connected to a cylinder head 12 of a compression-ignition combustion chamber 14 and sealed by a gasket 16. The glow plug 10 comprises a body 18, a surface ignition element 20, a rod 22, and means 24 for permitting thermal expansion and contraction of the ignition element 20 and maintaining continuous electrically-conductable and gas-impermeable contact between the ignition element 20 and the body 18.

The body 18 is cylindrically shaped and has first and second end portions 26,28 and a central axial bore 30 extending longitudinally therethrough. The surface ignition element 20 is of a smooth hollow cylindrical shape, free of stress concentrators, having first and second end portions 32,34 and is formed of an electrically-conductable ceramic, for example, silicon carbide. The ignition element first end portion 32 is disposed in electrically-conductable relation to the body second end portion 28 and extends axially therefrom. The ignition element 20 also includes gas-impermeable outer and inner surfaces 36,38 wherein the outer surface 36 is disposed substantially externally of both the rod 22 and the body 18 and is adapted to be exposed to the gases within the combustion chamber 14 while the inner surface 38 is sealed from those gases. By mounting the ceramic ignition element 20 substantially external of the rest of the glow plug the available heated surface area 36 for facilitating adequate surface ignition of the fuel is advantageously maximized.

The rod 22 has first and second end portions 40,42 wherein the rod second end portion 42 is connected to the ignition element second end portion 34 in continuous electrically-conductable and gas-impermeable relation.

The rod 22 is formed of an electrically-conductable ceramic, for example, silicon carbide, and coated with a suitable metal or metal alloy, for example copper, to reduce the rod's electrical resistance or, alternatively, the rod 22 is formed of a ceramic, for example reaction sintered silicon carbide, having a lower electrical resistance than that of the surface ignition element 20. Preferably, the ignition element second end portion 34 is integrally united to the rod second end portion 42 by a ceramic sintering process. A resilient electrically-insulative bushing 44 is radially disposed between the rod first end portion 40 and the body first end portion 26 in order to maintain the rod 22 is spaced and electrically-insulative relation through the body 18 and most of the inner surface 38 of the ignition element 20.

Referring to FIG. 2, the means 24 for permitting thermal expansion and contraction of the ignition element 20 and maintaining continuous electrically-conductable and gas-impermeable contact between the ignition element 20 and the body 18 includes an electrically-conductable compliant sleeve 46 radially disposed in current-conducting relation between the surface ignition element 20 and either the body second end portion 28 or the rod second end portion 42. In the preferred embodiment shown in FIG. 1 and FIG. 2, the compliant sleeve 46 includes first alternate or inner undulations 48 and second alternate or outer undulations 49 wherein the first alternate undulations 48 are gas-impermeably connected by brazing to the ignition element outer surface 36 at the ignition element first end portion 32 while the second alternate undulations 49 are gas-impermeably connected by brazing to the body second end portion 28. The sleeve 46 is formed of a compliant metal, for example, stainless steel, which can resiliently yield at the intermediate portions 50 located between any of the adjacent brazed undulations 48,49. In this manner, the compliant sleeve 46 accommodates differential thermal expansion between the body 18, the surface ignition element 20, and the rod 22 and yet maintains gas-impermeable and constant electrical contact resistance between the ignition element 20 and the rest of the glow plug electrical circuit.

A wire 52 forms part of the positive electrical circuit and is attached to a terminal cap 54 which is connected to the rod first end portion 40 while the cylinder head 12 forms part of the negative electrical circuit. Thus an electrical circuit is provided in the glow plug 10 such that an electrical current may be supplied through the wire 52, the terminal cap 54, the rod 22, the surface-ignition element 20, the sleeve 46, the body 18, and thence to the grounded cylinder head 12. Due to the higher resistivity of the uncoated thin-walled ceramic ignition element 20, substantially all electrical resistance heating will occur at the surface ignition element 20. The amount of electrical current passing through the glow plug electrical circuit may be selectively adjusted so that the ignition element heats up to a preselected temperature normally in excess of about 871° C. (1600° F.) thereby providing a sufficiently hot surface to ignite a wide range of relatively lower-cetane-number alternative fuels. Of course, electrical current may be discontinued to the glow plug 10 when the engine is shut off or during engine operation if conventional relatively higher-cetane-number diesel fuel is being combusted.

Figure 4:
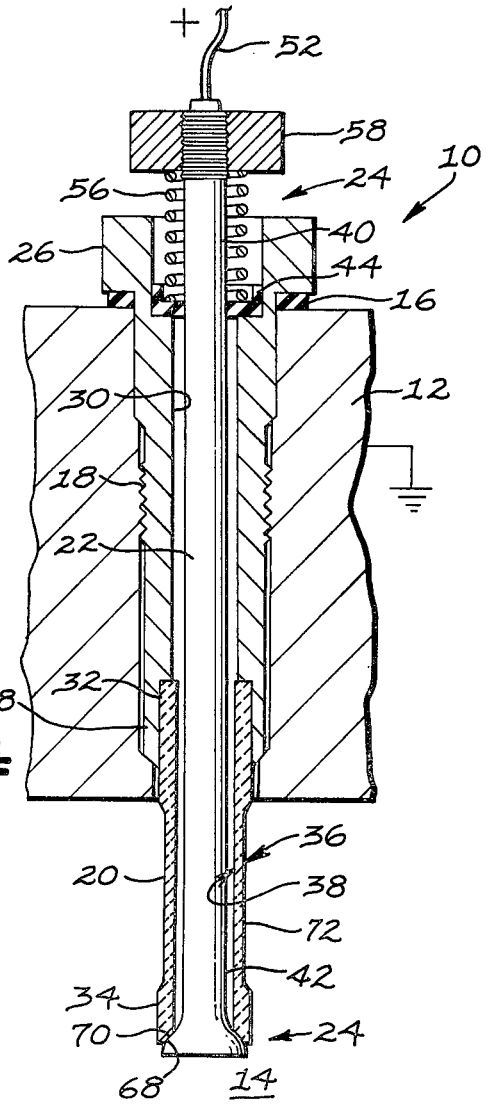
FIG. 4 is a cross-sectional view of a second alternative embodiment of the present invention.

Referring to FIG. 3 and FIG. 4, first and second alternative embodiments of the present invention are shown. These alternative embodiments differ from the preferred embodiment of FIG. 1 and FIG. 2 mainly in that rather than using the compliant sleeve 46 (FIGS. 1,2) the means 24 for permitting thermal expansion and contraction of the ceramic ignition element 20 comprises a spring, located between the rod first end portion 40 and the body first end portion 26, and a gas-impermeable, electrically conductive, nonrigid connection between the ignition element 20 and either the body second end portion 28 or the rod 22. More particularly, the permitting means 24 includes a helical compression spring 56 positioned between the terminal cap 54 (FIG. 3) or nut 58 (FIG. 4) of the rod first end portion 40 and the electrically-insulative bushing 44. The spring 56 forces the rod 22 to urge the ignition element 20 towards the body 18 so that relative electrically-conductable and gas-impermeable contact between the body 18, the rod 22, and the ignition element 20 is maintained.

FIG. 3 also illustrates an embodiment wherein a high-temperature-resistant metal alloy sleeve 60 is axially disposed in electrically-conductable and gas-impermeable relation between the body second end portion 28 and the ignition element first end portion 32 with the rod 22 extending through the sleeve 60. The sleeve 60 may be incorporated in any of the other embodiments in order to help isolate the relatively cooler body 18 from the normally much hotter ignition element 20 and also to prevent glow plug seating forces from stressing the ceramic ignition element 20 as the glow plug 10 is seated in the cylinder head 12 during installation. The sleeve 60 has first and second end portions 62,64 wherein the sleeve first end portion 62 is brazed or, alternatively, press-fitted into the body second end portion 28. The sleeve second end portion 64 tightly seats onto the ignition element first end portion 32 and those mating surfaces 66 may be lapped if desired. The interface 66 forms the nonrigid connection which in combination with the resiliently mounted rod 22 and ignition element 20 accommodates differential thermal expansion and contraction between the body 18, the sleeve 60, the ignition element 20, and the rod 22. Moreover, the spring 56 acting through the rod 22 and ignition element 20, ensures that the interface 66 is continuously electrically conductable and gas impermeable.

FIG. 4 shows an embodiment wherein the ceramic ignition element 20 is directly connected to the body second end portion 28 by a light press fit or a loose fit with closely machined finished surfaces to assure gas-impermeable and electrically-conductable contact between the ignition element 20 and the body second end portion 28. At the ignition element second end portion 34 is a machined internal conical or spherical surface 68. Mating against this surface 68 is the rod second end portion 42 which has an external spherical surface or head 70. In this embodiment the rod 22 is formed of a high temperature metallic alloy. Similar to the interface 66 of FIG. 3, the mating surfaces 68,70 of FIG. 4 form the nonrigid connection which in combination with the resiliently mounted rod 22 accommodates differential thermal expansion and contraction between the body 18, the ignition element 20, and the rod 22. Again, the spring 56 acting through the rod 22 and ignition element 20 ensures that the mating surfaces 68,70 are continuously electrically-conductable and gas impermeable.

FIG. 4 also illustrates that any of the embodiments may have a middle portion 72 of the outer surface 36 of the surface ignition element 20 which has been ground down in order to position the highest electrically heated portion 72 of the surface ignition element 20 at a preselected location relative to the fuel mixture in the combustion chamber.

INDUSTRIAL APPLICABILITY

In order to easily adapt conventional compression-ignition engines to burn a wide range of relatively lower-cetane-number alternative fuels, such as methanol, I have invented an improved glow plug which is adapted to be continuously electrically heated to a preselected elevated temperature normally in excess of about 871° C. (1600° F.) during engine operation in order to ignite those fuels.

An electrically-conductable and gas-impermeable ceramic surface ignition element 20, free of stress concentrators and highly resistant to oxidation and other chemical attack, is resiliently and externally mounted to the glow plug body 18 so as to accommodate any differential thermal expansion and contraction and yet adequately maintain electrically conductable and gas-impermeable contact between these elements.

In the preferred embodiment shown in FIG. 1 and FIG. 2 an undulated compliant sleeve 46 is brazed at its first alternate and second alternate undulations 48,49 between the surface ignition element first end portion 32 and the body second end portion 28. The brazed connections ensure that a constant electrical contact resistance and gas-impermeable connection is maintained between the ignition element 20 and the body 18. Moreover, when differential thermal expansion or contraction occurs between the ignition element 20, the body 18, or the rod 22, the intermediate portions 50 of the compliant sleeve 46 may resiliently yield to prevent brittle fracture of the ceramic surface ignition element.

In the alternative embodiments shown in FIG. 3 and FIG. 4, a helical compression spring 56 is positioned between the rod first end portion 40 and the body first end portion 26 which urges the rod 22 to apply a force against the ignition element 20 in the direction away from the body second end portion 28 and towards the body first end portion 26. At least one of the end portions 32,34 of the ignition element is nonrigidly connected to either the body 18, an intermediate sleeve 60 (FIG. 3), or the rod 22 (FIG. 4). The norigid connection acting in combination with the resiliently mounted rod 22 accommodates differential thermal expansion and contraction between the ignition element 20 and other parts of the glow plug 10. Moreover, the resiliently mounted rod 22 acting against the ignition element 20 ensures that the nonrigid connection is continuously electrically-conductable and gas impermeable.

In summary, my invention provides an improved glow plug 10 which is adapted to be continuously electrically heated within a preselected elevated temperature range in order to ignite relatively lower-cetane-number alternative fuels in a conventional compression-ignition engine. Furthermore, my improved glow plug has an externally mounted, highly corrosion-resistant, ceramic ignition element 20 which is permitted to thermally expand and contract and yet maintain continuous electrically-conductable and gas-impermeable contact with the rest of the electrical circuit of the glow plug 10.

Other aspects, objects, and advantages of this invention can be obtained from a study of the drawings, the disclosure, and the appended claims.

I claim:

1. A glow plug (10) adapted to be continuously electrically heated to a preselected elevated temperature for igniting a fuel in a combustion chamber (14) comprising:

an electrically-conductable cylindrical body (18) having first and second end portions (26,28) and a central axial bore (30) extending longitudinally therethrough;

a tubular gas-impermeable electrically-conductable ceramic surface-ignition element (20) having first and second end portions (32,34) and outer and inner surfaces (36,38) extending from said first end portion (32) to said second end portion (34), said ignition element first end portion (32) being mounted in continuous gas-impermeable and electrically-conductable relation to the body second end portion (28) and extending axially outwardly therefrom, said ignition element outer surface (36) being disposed substantially externally of the body 18 and being adapted to be exposed to gases in the combustion chamber (14);

an electrically-conductable rod (22) having first and second end portions (40,42) and extending through said body bore (30) and said surface-ignition element (20), said rod (22) being positioned in radially-inwardly-spaced and electrically-insulative relation relative to the body (18) and the ignition element first end portion (32), said rod second end portion (42) contacting said ignition element second end portion (34) in continuous electrically-conductable and gas-impermeable relation;

a resilient electrically-insulative bushing (44) radially disposed between said rod first end portion (40) and said body first end portion (26); and means (24) for permitting thermal expansion and contraction of the surface-ignition, element (20) and maintaining continuous electrically-conductable and gas-impermeable contact between said surface-ignition element and said body (18) wherein said permitting means (24) includes an electrically-conductable compliant sleeve (46) radially disposed in current-conducting relation between the surface ignition element (20) and said body second end portion (28), said compliant sleeve (46) having first and second alternate undulations (48,49), said first alternate undulations (48) being gas-impermeably connected to said ignition element (20), said second alternate undulations (49) being gas-impermeably connected to said body second end portion (28).

2. The glow plug (10) as set forth in claim 1 wherein said first alternate undulations (48) are gas-impermeably connected to the ignition element first end portion (32) and said second alternate undulations (49) are gas-impermeably connected to the body second end portion (28), said rod (22) extending through the compliant sleeve (46) in radially-inwardly-spaced and electrically-insulative relation.

* * * * *

UNITED STATES PATENT AND TRADEMARK OFFICE

CERTIFICATE OF CORRECTION

PATENT NO. : 4,475,030

DATED : October 2, 1984

INVENTOR(S) : JOHN M. BAILEY

It is certified that error appears in the above-identified patent and that said Letters Patent is hereby corrected as shown below:

Column 7, line 5 change "norigid" to "nonrigid"; and

Column 8, line 20 after "surface-ignition" delete ",".

Signed and Sealed this

*Nineteenth* Day of *February 1985*

[SEAL]

*Attest:*

DONALD J. QUIGG

*Attesting Officer* *Acting Commissioner of Patents and Trademarks*